US005670234A

United States Patent [19]

Suehr et al.

[11] Patent Number: 5,670,234

[45] Date of Patent: Sep. 23, 1997

[54] TRICOT NONWOVEN FABRIC

[75] Inventors: Susan Lynn Suehr, Belle Mead; William F. Kelly, Middlesex; Charles Shimalla, Plainsboro; Frank J. Flesch, Toms River; James E. Knox, Jamesburg, all of N.J.

[73] Assignee: McNeil-PPC, Inc., Skillman, N.J.

[21] Appl. No.: 362,322

[22] Filed: Dec. 22, 1994

Related U.S. Application Data

[63] Continuation of Ser. No. 131,191, Sep. 13, 1993, abandoned.

[51] Int. Cl.[6] ..... B32B 3/24

[52] U.S. Cl. ..... 428/131; 428/134; 28/104; 28/105; 28/106; 442/50; 442/408

[58] Field of Search ..... 428/131, 134, 428/224; 28/104, 105, 106; 422/50, 408

[56] References Cited

U.S. PATENT DOCUMENTS

| | | | |
|---|---|---|---|
| 1,978,620 | 4/1934 | Brewster | 428/119 |
| 2,862,251 | 2/1958 | Kalwaites | 264/119 |
| 3,025,585 | 11/1962 | Griswold | 28/106 |
| 3,033,721 | 5/1962 | Kalwaites | 428/224 |
| 3,081,500 | 3/1963 | Griswold et al. | 264/119 |
| 3,081,501 | 3/1963 | Kalwaites | 28/106 |
| 3,081,515 | 3/1963 | Griswold et al. | 428/131 |
| 3,104,998 | 9/1963 | Gelpke | 428/135 |
| 3,240,657 | 3/1966 | Hynek | 428/188 |
| 3,284,857 | 11/1966 | Hynek | 28/105 |
| 3,330,009 | 7/1967 | Hynek | 28/105 |
| 3,485,706 | 12/1969 | Evans | 428/134 |
| 3,486,168 | 12/1969 | Evans et al. | 428/163 |
| 3,498,874 | 3/1970 | Kalwaites | 428/134 |
| 3,679,535 | 7/1972 | Kalwaites | 428/131 |
| 3,681,182 | 8/1972 | Kalwaites | 428/131 |
| 3,681,183 | 8/1972 | Kalwaites | 428/131 |
| 3,681,184 | 8/1972 | Kalwaites | 428/134 |
| 3,682,756 | 8/1972 | Kalwaites | 28/105 |
| 3,750,236 | 8/1973 | Kalwaites | 28/104 |
| 3,750,237 | 8/1973 | Kalwaites | 28/105 |
| 3,768,121 | 10/1973 | Kalawaites | 28/105 |
| 3,787,932 | 1/1974 | Kalwaites | 28/105 |
| 3,800,364 | 4/1974 | Kalwaites | 28/105 |
| 3,873,255 | 3/1975 | Kalwaites | 28/104 |
| 4,379,799 | 4/1983 | Holmes et al. | 428/131 |
| 4,465,726 | 8/1984 | Holmes et al. | 428/131 |
| 4,735,842 | 4/1988 | Buyofsky et al. | 28/106 |
| 4,840,829 | 6/1989 | Suzuki et al. | 428/131 |
| 5,098,764 | 3/1992 | Drelich et al. | 428/131 |
| 5,204,158 | 4/1993 | Phillips et al. | 28/106 |

FOREIGN PATENT DOCUMENTS

| | | |
|---|---|---|
| 0291032 | 5/1987 | European Pat. Off. . |
| 2200927 | 12/1987 | United Kingdom . |

*Primary Examiner*—William Watkins

[57] ABSTRACT

A nonwoven fabric of entangled fibers defining a predetermined pattern of openings with the fabric having excellent draping characteristics.

5 Claims, 4 Drawing Sheets

TRICOT NONWOVEN FABRIC

This is a continuation, of application Ser. No. 08/131,191, filed Sep. 13, 1993, abandoned which is hereby incorporated by reference.

BACKGROUND OF THE INVENTION

Nonwoven fabrics have been known for many years. Many nonwoven fabrics are produced by forming a web or batt of textile like fibers and treating the fiber batt with binder to hold fibers together and provide some strength to the batt. In other instances a nonwoven fabric may be produced by treating a fiber batt with water streams to cause the fibers to entangle with each other and provide some strength in the batt. Many methods have been developed for treating fiber batts in such a manner in an attempt to duplicate the physical properties and appearance of woven fabrics. While the methods developed for producing nonwoven fabrics have produced fabrics with some of the characteristics of woven or knitted fabrics, one property, namely drapability, has been difficult to achieve. None of the nonwoven fabrics produced to date have had the appearance, drapability or flexibility of tricot knit fabrics.

It is an object of the present invention to produce a nonwoven fabric which emulates the appearance and draping characteristics of the tricot knitted fabrics.

It is a further object of the present invention to produce a very drapable nonwoven fabric having good strength in all directions. Further objects of the present invention will be apparent from the following detailed description.

SUMMARY OF THE PRESENT INVENTION

The nonwoven fabrics of the present invention have an upper surface and a lower surface. Disposed between these surfaces are a plurality of fibers. The fibers are intertwined and interentangled with each other and define a predetermined pattern of openings in the nonwoven fabric. A portion of the openings include a fiber segment loop disposed in the opening. The loop comprises a plurality of substantially parallel fiber segments which are in the shape of a U. The open end of the U is directed towards one surface of the fabric while the closed end of the U is directed towards the opposite surface of the fabric. The nonwoven fabrics of the present invention have excellent drapability and have a drape index in all directions of the fabric of 75 degrees or greater.

DETAILED DESCRIPTION OF THE INVENTION

Figure 1:
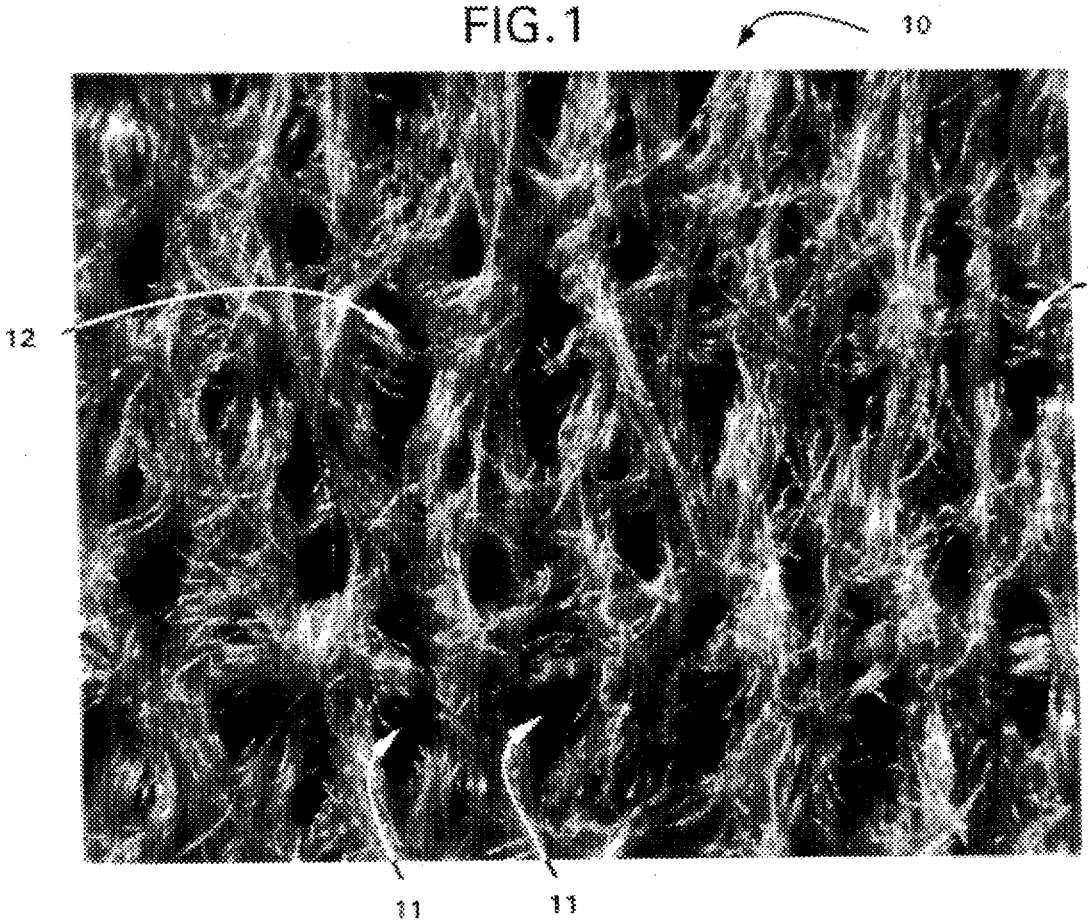
FIG. 1 is a photomicrograph of a nonwoven fabric of the present invention enlarged about 20 times, as seen from the upper surface which surface faces away from a support member on which the fabric is formed.
Figure 2:
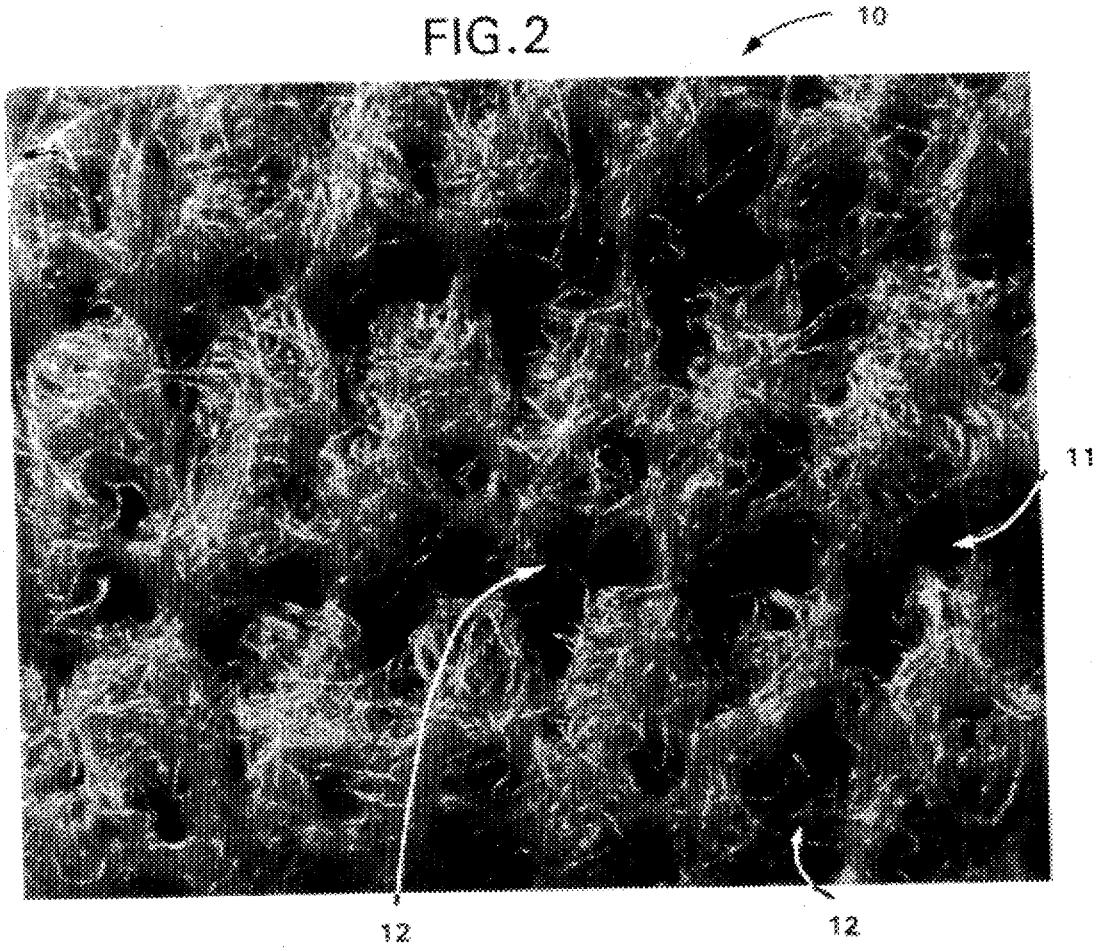
FIG. 2 is a photomicrograph of a nonwoven fabric of the present invention enlarged about 20 times, as seen from the bottom surface which surface is supported on the support member on which the fabric is formed.

Referring to the drawings, FIG. 1 is a photomicrograph of a nonwoven fabric of the present invention at an enlargement of approximately 20 times. The fabric 10 is made from a plurality of fibers. As seen in the photomicrograph, the fibers are intertwined and interentangled and form a pattern of openings 11 in the fabric. A number of these openings include a loop 12 formed from fiber segments. Each loop is made from a plurality of substantially parallel fiber segments. The loop is in the shape of a U with the closed end of the U pointed upwardly towards the upper surface of the fabric as viewed in the photomicrograph. FIG. 2 is a photomicrograph of the opposite surface of the fabric of FIG. 1 at an enlargement of about 20 times. The fibers in the fabric are intertwined and entangled to form a pattern of openings 11 in the fabric. In some of these openings there are U-shaped loops 12 formed from substantially parallel fiber segments. When viewed from this bottom surface of the fabric, the open end of the U-shaped loop is pointed towards the surface of the fabric viewed in this photomicrograph.

Figure 3:
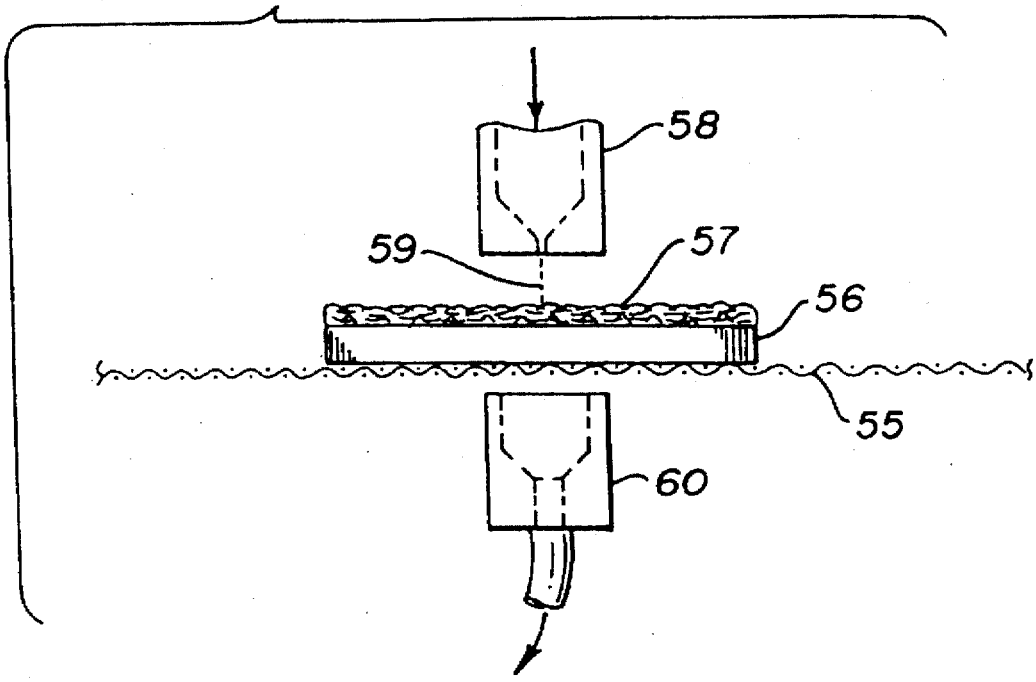
FIG. 3 is a schematic sectional view of one type of apparatus for producing the nonwoven fabrics of the present invention.

FIG. 3 is a schematic cross-sectional view of apparatus which may be used to produce fabrics of the present invention. The apparatus includes a movable conveyer belt 55. Placed on top of this belt to move with the belt is a topographically configured support member 56. The support member has a plurality of raised three-dimensional areas. Holes or openings extending through the support member are disposed between these three dimensional areas as will be more fully discussed in conjunction with FIG. 5. The fiber web 57 to be treated is disposed or supported at the top of the three dimensional areas. The web may be a web of carded fibers, air laid fibers, melt blown fibers or the like. Above the fiber web is a manifold 58 for applying fluid 59, preferably water, through the fibrous web as the fibrous web is supported on the support member and moved on the conveyer belt beneath the manifold. The water may be applied at varying pressures. Disposed beneath the conveyer belt is a vacuum manifold 60 for removing water from the area as the web and support member are passed under the fluid manifold. In operation, the fiber web is placed on the support member and the fiber web and support member passed under the fluid manifold. Water is applied to the fibers to wet out the fiber web, as to be certain the web is not moved or disrupted from its position on the support member upon further treatment. Thereafter, the support member and web are passed beneath the manifold a series of times. During these passes, the pressure of the water of the manifold is increased from a starting pressure of about 100 psi to pressures of 1000 psi or more. The manifold consists of a plurality of orifices of from about 4 to 100 or more holes per inch. Preferably, the number of the holes in the manifold is 13 to 70 per inch. The holes may have a diameter of from 3/1000 of an inch to 19/1000 of an inch.

Figure 4:
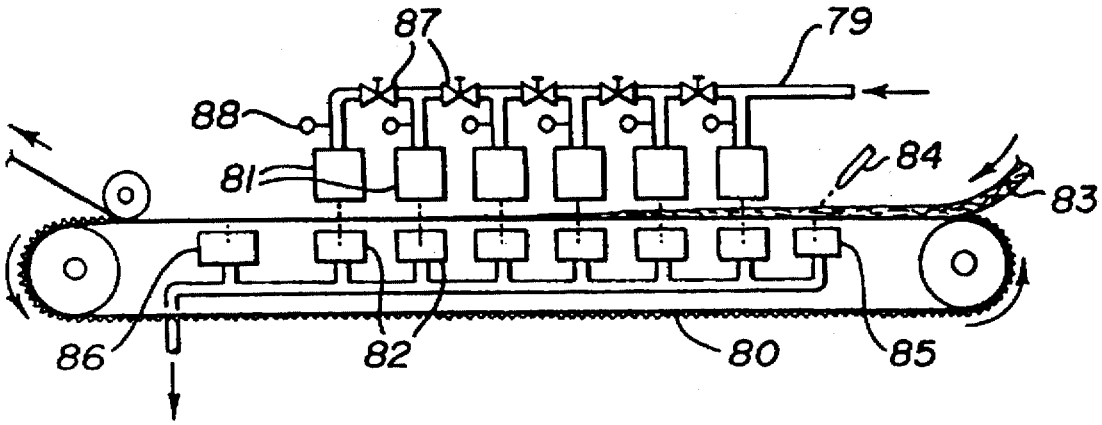
FIG. 4 is a diagrammatic view of another type of apparatus for producing nonwoven fabrics of the present invention.

In FIG. 4, there is depicted an apparatus for continuously producing fabrics in accordance with the present invention. The schematic representation includes a conveyer belt 80 which serves as a support member in accordance with the present invention. The belt is continuously moved in a counter-clockwise direction about spaced apart members as is well known in the art. Disposed above this belt is a fluid feeding manifold 79 connecting a plurality of lines or groups of orifices 81. Each group has one or more rows of fine diameter holes with 30 or more holes per inch. The manifold is equipped with pressure gauges 88 and control valves 87 for regulating fluid pressure in each line or group of orifices.

Disposed beneath each orifice line or group is a suction member 82 for removing excess water and to keep the water from causing undue flooding. The fiber web 83 to be treated and formed into a fabric according to the present invention is fed to the support member conveyer belt. Water is sprayed through an appropriate nozzle 84 onto the fibrous web to prewet the web and aid in controlling the fibers as they pass under the pressure manifolds. A suction box 85 is placed beneath the water nozzle to remove excess water. The fibrous web passes under the fluid feeding manifold with the manifold preferably having progressively increasing pressures. For example, the first line of holes or orifices may supply fluid forces at 100 psi while the next line of orifices may supply fluid forces at a pressure of 300 psi and the last line of orifices may supply fluid forces at a pressure of 700 psi. Though 6 lines of orifices are shown, the number of lines or rows of orifices is not critical, but will depend on the width of the web, the speed, the pressure used, the number of rows and holes in each line, etc. After passing between the fluid feeding and the suction manifolds, the formed fabric is passed over an additional suction box 86 to remove excess water from the web. The support member may be made from relatively rigid material and may comprise a plurality of slats. Each slat extends across the width of the conveyer and has a lip on one side and a shoulder on the opposite side so that the shoulder of one slot engages with the lip of an adjacent slot to allow for movement between adjacent slots and allow for these relatively rigid members to be used in the conveyer configuration shown in FIG. 4. Each orifice strip comprises one or more rows of very fine diameter holes of approximately 7/1000 of an inch. There are approximately 50 holes per inch across the orifice strip.

Figure 5:
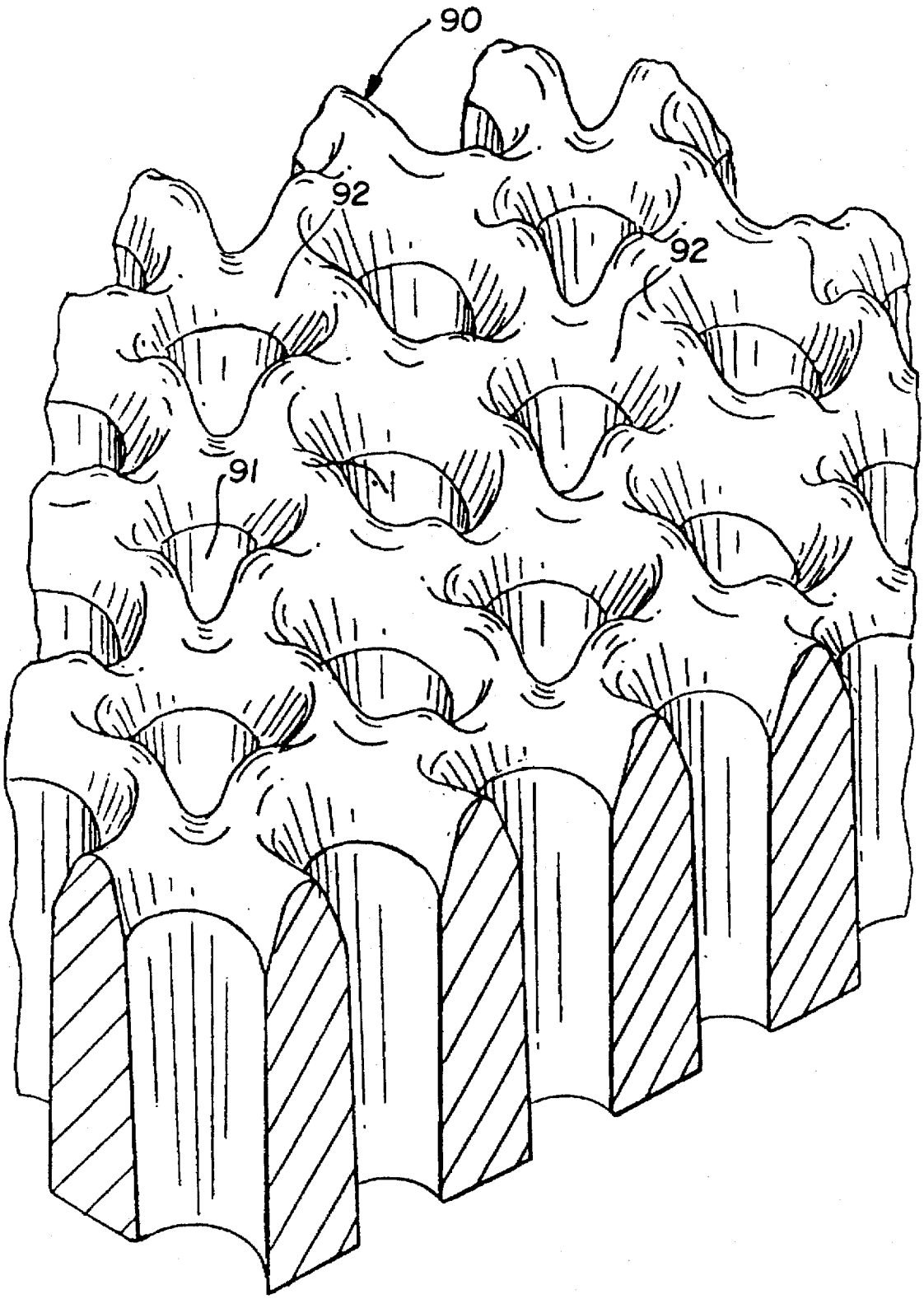
FIG. 5 is a perspective view of one type of topographical support member that may be used in the apparatus depicted in FIG. 4.

FIG. 5 is a perspective view of one type of support member that may be used to produce the fabrics of the present invention. The member comprises a plate 90 having a plurality of openings 91 extending through the thickness of the plate. The openings are aligned in rows extending the length and width of the plate. The top portion of each opening has a conical shape 92. The conical shape surfaces are relatively smooth with varying undulations as seen in the Figure. The surface formed from the conical shapes is the surface on which the fiber web is placed and treated in accordance with the present invention.

Following is a specific example of a method for producing the fabrics of the present invention.

EXAMPLE

In this Example, the starting web used to make a fabric according to the present invention comprises 100% cotton fibers. The web weighs 2.5 ounces per square yard and comprises a 1.5 ounce per sq. yd. randomized web laminated on top of a 1.0 ounce per sq. yd. carded web. The web is prebonded by placing it on a 100×92 mesh bronze belt and passing the web and belt under columnar water jet streams. The jet streams are produced from 0.007 inch diameter orifices arranged in a row running in the transverse direction or the width of the web. There are 30 orifices per inch. The web is passed under the columnar jet streams at a speed of 92 ft/min. Three passes are made at 100 psig and 9 passes at 900 psig. The web to orifice spacing is 0.75 inch. The pretreated web is removed from the belt surface, turned over and placed on a forming plate as depicted in FIG. 5. The forming plate and web are passed under columnar water jet streams as described above. The plate and web are passed under the jet streams at 90 ft/min. One pass is made at 600 psig and 7 passes at 1400 psig. The resulting fabric is dried on drying cans to remove the water.

As previously mentioned, the fabrics of the present invention have excellent drapability in all directions of the fabric. While drapability may be measured by various techniques, the drapability of the fabrics of the present invention are measured by taking a 12 inch×12 inch square of the fabric and conditioning it for at least 6 hours in a room at a temperature of 70° F. and a relative humidity of 65 percent. The conditioned fabric is placed on a flat, horizontal surface and one edge of the fabric moved over the edge of the surface so that 6 inches of the fabric extends beyond the surface edge and is unsupported by the surface. The angle the fabric deflects from the horizontal surface is measured. This angle is called the drape index of the fabric. The fabrics are tested in the machine direction, the cross direction and at 45 degrees and 135 degrees from the machine direction.

A comparison of the drapability of the fabrics of the present invention with prior art nonwoven fabrics is made. The fabric of the present invention made as described in the previous Example is processed through a binder pad operation and impregnated with 20% acrylic binder pickup and dried on drying cans.

One of the comparative prior art samples is made using the same base web of 2½ ounces per square yard, the web is treated and formed into a nonwoven fabric as described in U.S. Pat. No. 3,485,706. Another comparative sample is made using the 2½ ounces per square yard base web. The web is treated and formed into a fabric as described in U.S. Pat. No. 5,098,764. The fabric of the invention described above and the fabrics made as described in U.S. Pat. Nos. 3,485,706 and 5,098,764 are passed through a jet dyeing process to enhance properties. The process used is a standard dyeing process used on many apparel and home finishing fabrics to soften the fabric and provide uniform color distribution. Such finishing processes are standard in the textile industry and are used with many woven, knit and nonwoven fabrics. The other fabric compared is a commercial entangled nonwoven fabric sold by DuPont under the trademark Sontara. This fabric is made from polyester and pulp fibers which are not as stiff as cotton fibers. The fabric is commercially finished to enhance softness and drapability. Cotton is used in the comparison since it has poor drapability as a result of the stiffness properties of cotton. The drape index of each of the three fabrics is determined by the drapability test previously described. Each of the samples is tested in the machine direction, the cross-direction, and at 45 degrees and 135 degrees to the machine direction. The samples had the following drape indices:

TABLE

| Drape Index | Fabric of Present Invention | U.S. Pat. No. 3,485,706 | U.S. Pat. No. 5,098,764 | Sontara |
|---|---|---|---|---|
| Machine Direction | 80° | 65° | 75° | 72° |
| Cross Direction | 87° | 85° | 85° | 84° |
| 45° | 81° | 63° | 77° | 66° |
| 135° | 80° | 63° | 71° | 66° |

As may be seen from the above table, the fabrics of the present invention have a drapability index of at least 75 degrees and preferably 80 degrees or more in all directions of the fabric. Preferably, the drapability of the fabrics of the present invention, in the machine direction, is at least 80 degrees and in the cross-direction is at least 85 degrees.

Having now described the invention in specific detail and exemplified the manner in which it may be carried into practice, it will be readily apparent to those skilled in the art that many variations, applications, modifications, and extensions of the basic principles involved may be made without departing from its spirit or scope.

What is claimed is:

1. A nonwoven fabric formed on a topographically configured support member having a plurality of raised, three-dimensional areas and a plurality of holes between said three-dimensional areas and extending through said support member, said fabric having an upper surface facing away from said support member when said fabric is formed and a lower surface supported on the top of said three dimensional areas when said fabric is formed, said fabric comprising a plurality of fibers disposed between said surfaces, said fibers being rearranged by the application of fluid under pressure to the fabric upper surface and said fibers being intertwined and interentangled with adjacent fibers to define a pattern of openings extending through said fabric, a portion of said openings having a fiber segment loop disposed therein, said loop comprising a plurality of substantially parallel fiber segments in the shape of U with the open inside surface of the base of the U directed towards said lower surface of said fabric and the outside surface of the base of the U directed towards said upper surface of said fabric, said parallel fiber segments being arranged generally transversely of the thickness of said fabric, said fabric having a drape index in all directions of the fabric of at least about 80 degrees.

2. A nonwoven fabric according to claim 1 wherein the loops are disposed in substantially the center of the opening.

3. A nonwoven fabric according to claim 1 wherein the openings in the fabric are in a pattern of rows with said rows of openings extending in the longitudinal and cross directions of the fabric.

4. A nonwoven fabric according to claim 3 wherein the loops are disposed in spaced apart rows of openings extending in the cross direction of the fabric.

5. A nonwoven fabric formed on a topographically configured support member having a plurality of raised, three-dimensional areas and a plurality of holes between said three-dimensional areas and extending through said support member, said fabric having an upper surface facing away from said support member when said fabric is formed and a lower surface supported on the top of said three-dimensional areas when said fabric is formed, said fabric comprising a plurality of fibers disposed between said surfaces, said fibers being rearranged by the application of fluid under pressure to the fabric upper surface and said fibers being intertwined and interentangled with adjacent fibers to define a pattern of openings extending through said fabric, a portion of said openings having substantially parallel fiber segments disposed therein and arranged generally transversely of the thickness of said fabric, said fabric having a drape index in all directions of the fabric of at least about 80 degrees.

* * * * *